US011181021B2

(12) United States Patent
Miyanaga et al.

(10) Patent No.: US 11,181,021 B2
(45) Date of Patent: Nov. 23, 2021

(54) OIL MIST SEPARATOR

(71) Applicant: TOYOTA BOSHOKU KABUSHIKI KAISHA, Aichi-ken (JP)

(72) Inventors: Naritsune Miyanaga, Toyota (JP); Hideto Morishita, Gifu (JP)

(73) Assignee: TOYOTA BOSHOKU KABUSHIKI KAISHA, Aichi-ken (JP)

( * ) Notice: Subject to any disclaimer, the term of this patent is extended or adjusted under 35 U.S.C. 154(b) by 195 days.

(21) Appl. No.: 16/253,703

(22) Filed: Jan. 22, 2019

(65) Prior Publication Data

US 2019/0226370 A1 Jul. 25, 2019

(30) Foreign Application Priority Data

Jan. 25, 2018 (JP) ..... JP2018-010395

(51) Int. Cl.
*F01M 13/04* (2006.01)

(52) U.S. Cl.
CPC ..... *F01M 13/04* (2013.01); *F01M 2013/0433* (2013.01); *F01M 2013/0461* (2013.01)

(58) Field of Classification Search
None
See application file for complete search history.

(56) References Cited

U.S. PATENT DOCUMENTS 4,515,137 A * 5/1985 Manolis ..... F01M 13/04 123/374
4,724,807 A * 2/1988 Walker ..... F01M 13/04 123/196 A
5,243,950 A * 9/1993 Dalupan ..... B01D 47/021 123/536
7,080,636 B2 * 7/2006 Knaus ..... F01M 13/022 123/572
8,042,529 B2 * 10/2011 Meinig ..... F01M 13/04 123/572

(Continued)

FOREIGN PATENT DOCUMENTS

EP 3034823 6/2016
JP 2005-048601 2/2005

(Continued)

OTHER PUBLICATIONS

Office Action in Japanese Application No. 2018-010395, dated Sep. 7, 2021, along with an English translation thereof.

*Primary Examiner* — Bobby Ramdhanie
*Assistant Examiner* — Brit E. Anbacht
(74) *Attorney, Agent, or Firm* — Greenblum Bernstein, P.L.C.

(57) ABSTRACT

An oil mist separator includes a case including an inflow port into which blow-by gas flows and an outflow port out of which blow-by gas flows, a separation unit arranged in the case, and an oil discharge unit arranged at a lower part of the case. The oil mist separator is configured to separate oil mist contained in blow-by gas by the separation unit and discharge oil separated by the separation unit to an outside of the case through the oil discharge unit. The oil discharge unit includes a discharge port through which oil is discharged to the outside of the case and a constriction arranged above the discharge port. The constriction is partially decreased in a small cross-sectional flow area.

11 Claims, 3 Drawing Sheets

(56) References Cited

U.S. PATENT DOCUMENTS

| | | | | |
|---|---|---|---|---|
| 2010/0006075 | A1* | 1/2010 | Ruppel | F01M 13/023 123/573 |
| 2010/0126479 | A1* | 5/2010 | Shieh | F01M 13/04 123/573 |
| 2011/0179755 | A1* | 7/2011 | Gruhler | B29C 65/58 55/320 |
| 2011/0290225 | A1* | 12/2011 | Torella | F01M 13/023 123/573 |
| 2012/0138171 | A1* | 6/2012 | Coolens | F16K 27/0209 137/511 |
| 2013/0276767 | A1* | 10/2013 | Polichetti | F01M 13/0416 123/573 |
| 2014/0109533 | A1* | 4/2014 | Horiuchi | B01D 46/0089 55/430 |
| 2014/0165512 | A1* | 6/2014 | Horiuchi | B01D 45/08 55/322 |
| 2014/0182568 | A1* | 7/2014 | Hwang | F01M 13/04 123/572 |
| 2015/0040767 | A1* | 2/2015 | Sugio | F04B 39/16 96/417 |
| 2017/0036149 | A1* | 2/2017 | Barley | B01D 45/08 |
| 2018/0207565 | A1* | 7/2018 | Morishita | F01M 13/0405 |

FOREIGN PATENT DOCUMENTS

| | | |
|---|---|---|
| JP | 2005-139934 | 6/2005 |
| JP | 2012-241551 | 12/2012 |
| JP | 2016-98711 | 5/2016 |
| JP | 2016-114034 | 6/2016 |

* cited by examiner

OIL MIST SEPARATOR

BACKGROUND

The present invention relates to an oil mist separator that separates oil mist contained in blow-by gas in an internal combustion engine.

An internal combustion engine typically includes a recirculation passage through which blow-by gas in a crankcase flows back to the intake passage. The recirculation passage includes an oil mist separator that separates oil mist contained in blow-by gas. Further, the oil mist separator typically includes an oil discharge unit that discharges the separated oil.

Japanese Laid-Open Patent Publication No. 2012-241551 describes an oil mist separator including a drain pipe that extends in the vertical direction. The drain pipe serves as an oil discharge unit. The drain pipe includes a discharge port at the lower end. Oil separated by the oil mist separator flows into the drain pipe. The oil that has flowed into the drain pipe is stored in the drain pipe when the relationship of balance is established between the weight of the oil, the viscosity of the oil, the surface tension of the oil, the pressure difference inside and outside the oil mist separator, and the like. This restricts backward flow of the blow-by gas through the discharge port. When the oil is stored at a predetermined depth in the drain pipe, the balance is lost. This causes the oil in the drain pipe to be discharged through the discharge port.

Japanese Laid-Open Patent Publication No. 2016-98711 describes an oil mist separator including an oil discharge unit extending in the vertical direction. The oil discharge unit includes a discharge port at the lower end. The discharge port includes a jiggle valve serving as a check valve that restricts blow-by gas from flowing backward through the discharge port. The jiggle valve includes a float accommodated in the oil discharge unit, a retainer located below the discharge port, and a shaft inserted through the discharge port to couple the float to the retainer. In such an oil mist separator, when the amount of oil is small in the oil discharge unit, the weight of the jiggle valve causes the jiggle valve to fall so that the float closes the discharge port. When oil is stored at a predetermined depth in the oil discharge unit, the buoyancy of the float causes the jiggle valve to rise so that the closed state of the discharge port caused by the float is cancelled. This causes oil to be discharged through the discharge port.

In the oil mist separator of Japanese Laid-Open Patent Publication No. 2012-241551, the restriction of the backward flow of blow-by gas through the discharge port of the drain pipe requires the depth of the oil in the drain pipe to be kept at a predetermined depth or greater. That is, the drain pipe needs to have a vertical dimension corresponding to the predetermined depth. This downwardly extends the drain pipe, thereby increasing the size of the oil mist separator.

The oil mist separator of Japanese Laid-Open Patent Publication No. 2016-98711 needs to include a jiggle valve. This increases the number of components of the oil mist separator.

SUMMARY

It is an object of the present invention to provide an oil mist separator that limits the backward flow of blow-by gas containing oil mist through the discharge port with a simple structure.

An oil mist separator that achieves the above-described object includes a case including an inflow port into which blow-by gas flows and an outflow port out of which blow-by gas flows, a separation unit arranged in the case, and an oil discharge unit arranged at a lower part of the case. The oil mist separator is configured to separate oil mist contained in blow-by gas by the separation unit and discharge oil separated by the separation unit to an outside of the case through the oil discharge unit. The oil discharge unit includes a discharge port through which oil is discharged to the outside of the case, and a constriction arranged above the discharge port. The constriction is partially decreased in a small cross-sectional flow area.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferable embodiments together with the accompanying drawings in which.

DETAILED DESCRIPTION

An oil mist separator 10 according to an embodiment will now be described with reference to FIG. 1.

The oil mist separator 10 is arranged at a middle portion of a recirculation passage (not shown), through which blow-by gas in a crank chamber of an onboard internal combustion engine flows back to an intake passage (not shown).

Figure 1:
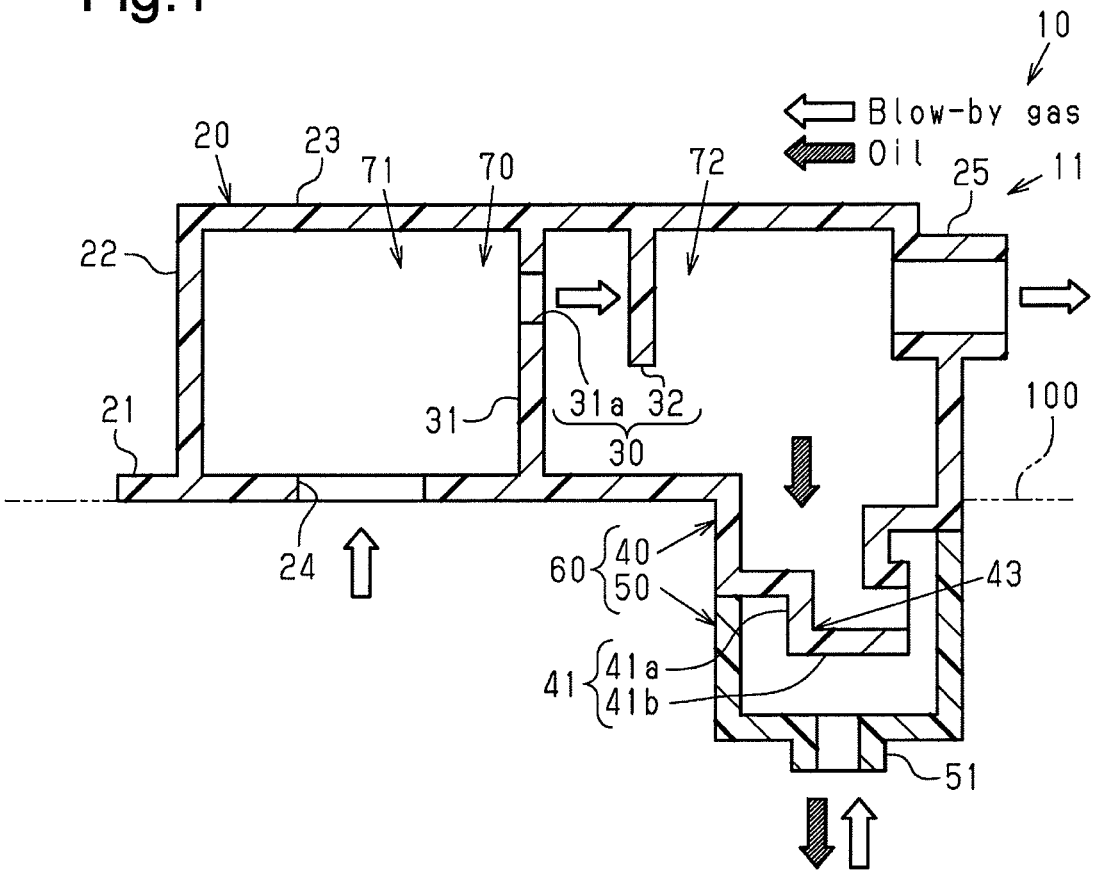
FIG. 1 is a cross-sectional view showing the structure of an oil mist separator according to an embodiment.

As shown in FIG. 1, the oil mist separator 10 includes a case 11 that configures part of a cylinder head cover 100. The case 11 includes a case body 20 and a cover 50. The case body 20 is elongated in a predetermined direction that is orthogonal to the vertical direction. The predetermined direction is the sideward direction in FIG. 1 and is hereinafter referred to as the longitudinal direction. The cover 50 is fixed to the lower end of the case body 20 closer to a first end (right end in FIG. 1) in the longitudinal direction. The case body 20 and the cover 50 are made of, for example, hard plastic materials. The case body 20 includes a bottom wall 21, a side wall 22 extending upward from the bottom wall 21, and a top wall 23 opposed to the bottom wall 21.

An inflow port 24 is arranged closer to a second end (left end in FIG. 1) of the bottom wall 21 in the longitudinal direction. The inflow port 24 communicates with the space between the cylinder head cover 100 and a cylinder head (not shown). Blow-by gas flows into the inflow port 24. The side wall 22 located closer to the first end (right end in FIG.

1) of the bottom wall 21 in the longitudinal direction includes a tubular outflow port 25 protruding outward. Blow-by gas flows out of the outflow port 25. A hose (not shown) that allows the inside of the case 11 and the intake passage to communicate with each other is connected to the outflow port 25.

The case body 20 includes a passage 70 through which blow-by gas flows from the inflow port 24 toward the outflow port 25.

The case body 20 includes a partition wall 31 coupled to the entire periphery of each of the bottom wall 21, the side wall 22, and the top wall 23. The passage 70 is divided by the partition wall 31 into an upstream passage 71 located on the upstream side in the flow direction of blow-by gas and a downstream passage 72 located on the downstream side in the flow direction of blow-by gas. The upper part of the partition wall 31 has a communication hole 31*a* that causes the upstream passage 71 and the downstream passage 72 to communicate with each other. The part of the downstream passage 72 located on the axis of the communication hole 31*a* includes a striking wall 32 extending downward from the top wall 23. In the present embodiment, the communication hole 31*a* and the striking wall 32 configure a separation unit 30 that separates oil mist contained in blow-by gas.

The first end (right end in FIG. 1) of the bottom wall 21 of the case body 20 in the longitudinal direction includes a tubular bulged part 40 bulged downward. The lower end of the bulged part 40 includes a constriction 41. The constriction 41 has a smaller cross-sectional flow area than the part located upward from the lower end of the bulged part 40. The constriction 41 includes a first constriction portion 41*a* extending downward and a second constriction portion 41*b* bent at the lower end of the first constriction portion 41*a* and extending in the longitudinal direction. That is, the intermediate portion of the constriction 41 includes a bent part 43.

A tubular cover 50 that covers the constriction 41 is fixed to the lower surface of the upper part of the bulged part 40. A tubular discharge port 51 protrudes from the lower end of the cover 50. Oil discharged from the constriction 41 is discharged to the outside of the case 11 through the discharge port 51. In the present embodiment, the bulged part 40 of the case body 20 and the cover 50 configure an oil discharge unit 60 that discharges the oil separated by the separation unit 30 to the outside of the case 11.

The basic operation of oil mist separator 10 will now be described.

Blow-by gas in the crank chamber flows through a recirculation passage formed in the cylinder block (not shown) and the cylinder head to the space between the cylinder head and the cylinder head cover 100.

As shown in FIG. 1, blow-by gas flows from the inflow port 24 into the upstream passage 71 in the case body 20.

Then, the blow-by gas passes through the communication hole 31*a* of the partition wall 31 to strike the striking wall 32. Since the communication hole 31*a* has a smaller cross-sectional flow area than the upstream passage 71, the flow speed of the blow-by gas passing through the communication hole 31*a* increases. Thus, collection of oil mist contained in the blow-by gas on the striking wall 32 separates the oil mist from the blow-by gas.

Subsequently, the blow-by gas from which the oil mist has been separated is discharged from the outflow port 25 through the hose to the intake passage.

The oil separated by the separation unit 30 from the blow-by gas flows along the bottom wall 21 into the bulged part 40 and flows through the constriction 41 into the cover 50.

The oil that has flowed into the cover 50 is discharged from the discharge port 51 to the outside of the case 11.

The advantages of the present embodiment will now be described.

(1) The oil discharge unit 60 includes the discharge port 51, out of which oil is discharged to the outside of the case 11, and the constriction 41, which is arranged above the discharge port 51 and is partially decreased in a small cross-sectional flow area.

In such a structure, the oil discharge unit 60 includes the constriction 41, which is located above the discharge port 51. This increases the pressure loss of blow-by gas that flows through the discharge port 51 into the oil discharge unit 60. This thus limits the flow of blow-by gas through the discharge port 51 into the case 11. Accordingly, the backward flow of blow-by gas containing oil mist through the discharge port 51 is limited with a relatively simple structure.

(2) The intermediate portion of the constriction 41 includes the bent part 43.

In such a structure, in a case in which blow-by gas flows through the discharge port 51 into the oil discharge unit 60, the blow-by gas strikes the inner surface of the bent part 43 when passing through the constriction 41. This separates oil mist contained in the blow-by gas and thus limits the backward flow of the blow-by gas containing the oil mist through the oil discharge unit 60.

(3) The outer surface of the constriction 41 is located on the center line of the discharge port 51.

Thus, when blow-by gas flows through the discharge port 51 into the case 11, the blow-by gas strikes the outer surface of the constriction 41. This separates oil mist contained in the blow-by gas and thus limits the backward flow of the blow-by gas containing the oil mist through the oil discharge unit 60.

(4) The case 11 is provided with the case body 20, which includes the constriction 41, and the cover 50, which includes the discharge port 51 and is fixed to the case body 20 to cover the constriction 41.

In such a structure, the case body 20 including the constriction 41 and the cover 50 including the discharge port 51 are separately formed to fix the cover 50 to the case body 20. This facilitates the formation of the oil discharge unit 60, which has a complicated shape because of the constriction 41.

It should be apparent to those skilled in the art that the present disclosure may be embodied in many other specific forms without departing from the spirit or scope of the disclosure. Particularly, it should be understood that the present disclosure may be embodied in the following forms.

In first to fifth modifications respectively shown in FIGS. 2 to 6, the same reference numbers are given to the same components as the above-described embodiment and the reference numbers to which 100, 200, 300, 400, and 500 are added are given to the components corresponding to the above-described embodiment. Thus, the overlapping description will be omitted.

Figure 2:
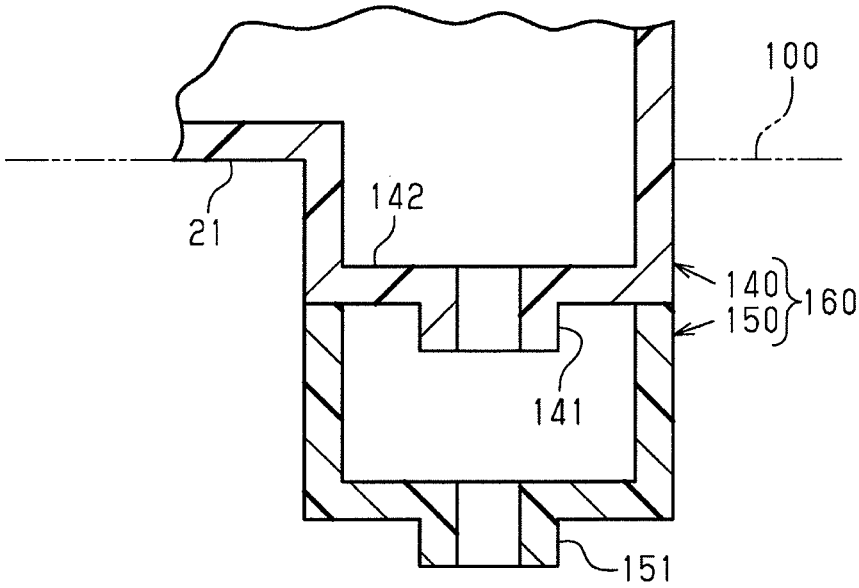
FIG. 2 is a cross-sectional view showing an oil discharge unit of an oil mist separator according to a first modification.
Figure 3:
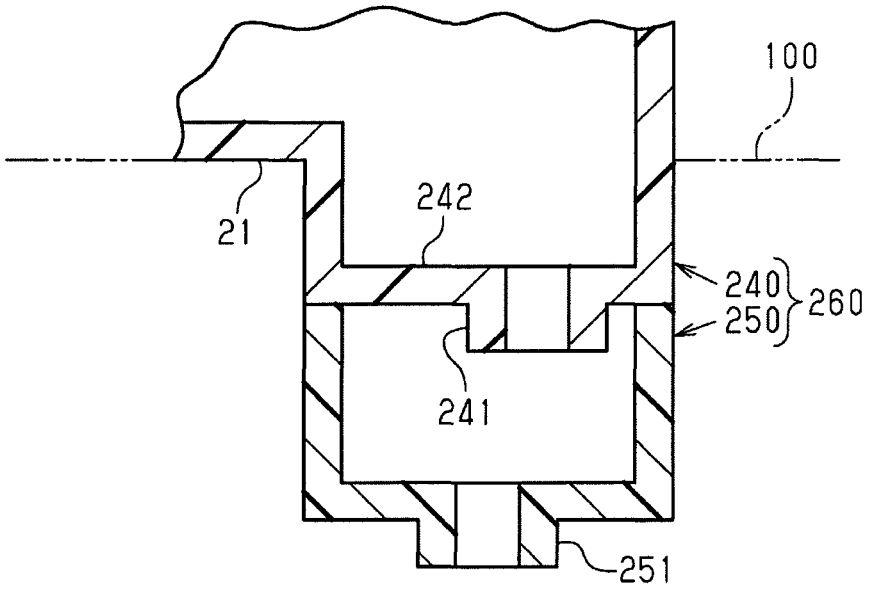
FIG. 3 is a cross-sectional view showing an oil discharge unit of an oil mist separator according to a second modification.

As shown in FIGS. 2 and 3, tubular constrictions 141 and 241 may respectively protrude downward from bottoms 142 and 242 of bulged parts 140 and 240.

In this case, as shown in the first. modification in FIG. 2, the constriction 141 may be located on the same axis as a discharge port 151 of a cover 150. Alternatively, as shown in the second modification in FIG. 3, the constriction 241 may deviate with respect to the center line of a discharge port 251. The constrictions 141 and 241 may have a smaller inner diameter than the discharge ports 151 and 251.

Particularly, the second modification has advantage (2) of the above-described embodiment.

Figure 4:
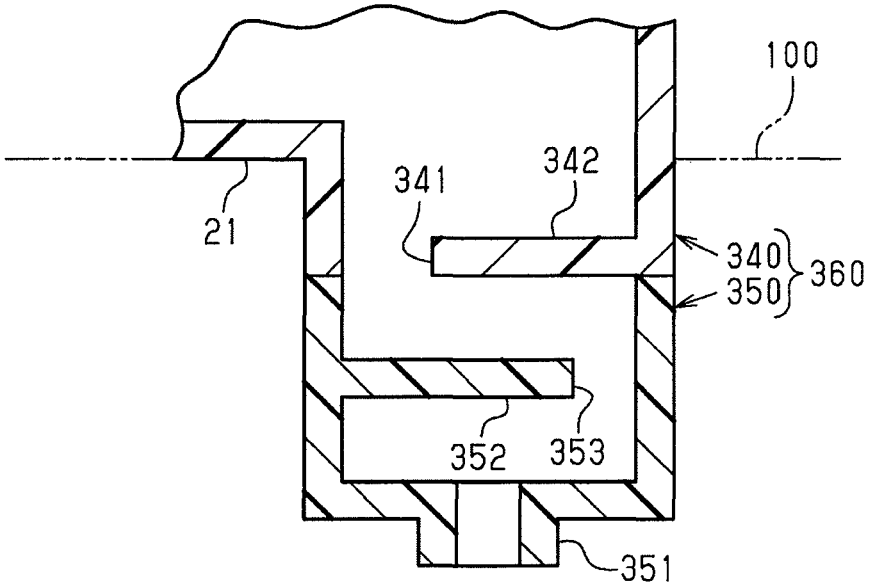
FIG. 4 is a cross-sectional view showing an oil discharge unit of an oil mist separator according to a third modification.

As shown in the third modification in FIG. 4, a communication hole that communicates with a bottom 342 of a bulged part 340 may configure a constriction 341. Further, a labyrinth structure may be formed by the bottom 342 and a protruding wall 352 protruding from the inner surface of the cover 350 so as to face the bottom 342. In addition, a constriction 353 may be formed between the distal end of the protruding wall 352 and the inner surface of the cover 350.

In such a structure, when blow-by gas flows through the discharge port 351 into the oil discharge unit 360, the blow-by gas strikes the lower surface of the protruding wall 352. This separates oil mist contained in the blow-by gas and thus limits the backward flow of the blow-by gas containing the oil mist through the oil discharge unit 360.

Figure 5:
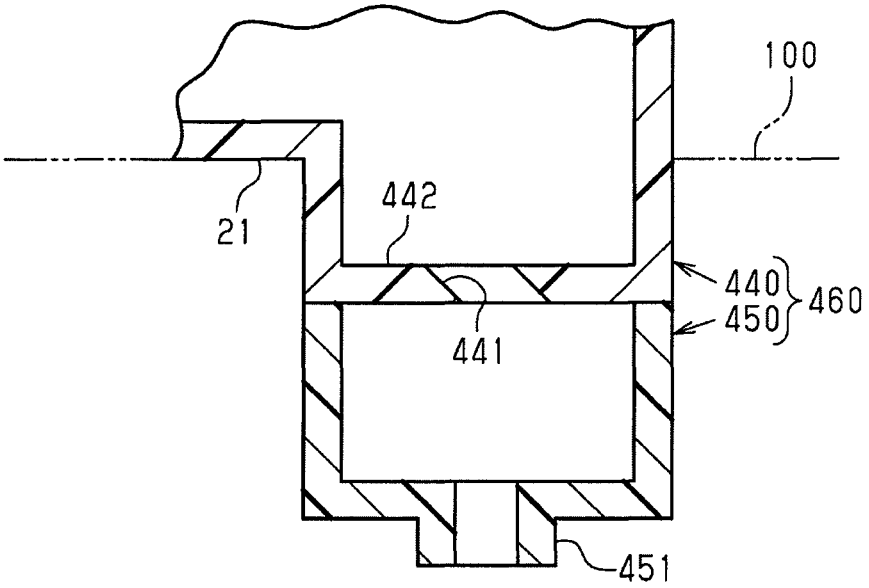
FIG. 5 is a cross-sectional view showing an oil discharge unit of an oil mist separator according to a fourth modification.

As shown in the fourth modification in FIG. 5, a constriction 441 may be formed by a through-hole that extends through a bottom 442 of a bulged part 440 and is inclined with respect to the center line of a discharge hole 451.

Figure 6:
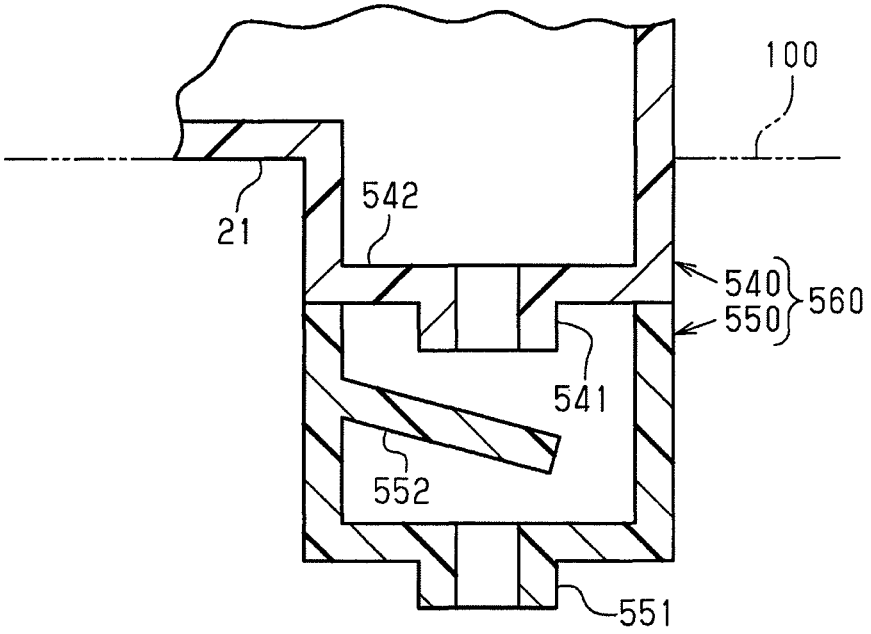
FIG. 6 is a cross-sectional view showing an oil discharge unit of an oil mist separator according to a fifth modification.

As shown in the fifth modification in FIG. 6, a tubular constriction 541 protruding downward from a bottom 542 of a bulged part 540 and a shielding wall 552 protruding from the inner surface of the cover 550 may be provided. In this case, when the shielding wall 552 is inclined so as to become lower toward the protruding end of the shielding wall 552, oil is discharged along the upper surface of the shielding wall 552. This increases the discharge efficiency of oil.

The number and shapes of constrictions may be changed.

Therefore, the present examples and embodiments are to be considered as illustrative and not restrictive and the disclosure is not to be limited to the details given herein, but may be modified within the scope and equivalence of the appended claims.

What is claimed is:

1. An oil mist separator comprising:
a case including:
a case body;
an inflow port into which blow-by gas flows into the case body;
an outflow port out of which blow-by gas flows out of the case body; and
a cover fixed to the case body;
a separation unit arranged in the case body; and
an oil discharge unit arranged at a lower part of the case, wherein
the oil mist separator is configured to separate oil mist contained in blow-by gas by the separation unit and discharge oil separated by the separation unit to an outside of the case body through the oil discharge unit, and
the oil discharge unit includes:
a discharge port projecting from the cover and through which the oil is discharged to the outside of the case, and
a constriction arranged above the discharge port,
wherein the constriction partially decreases in cross-sectional flow area in a flow direction of the separated oil toward the discharge port,
wherein the constriction has an inner diameter that is smaller than an inner diameter of the discharge port, and
wherein at least a portion of the constriction protrudes into the cover.

2. The oil mist separator according to claim 1, wherein
an opening of the constriction through which the oil is discharged from the constriction deviates with respect to a center line of the discharge port.

3. The oil mist separator according to claim 1, wherein
the case body includes the constriction, and
the cover includes the discharge port and covers the constriction.

4. The oil mist separator according to claim 1, wherein
the oil discharge unit includes a striking wall configured such that the blow-by gas flowing through the discharge port strikes the striking wall.

5. The oil mist separator according to claim 1, wherein
the cover is directly fixed to the case body.

6. An oil mist separator comprising:
a case including:
a case body;
an inflow port into which blow-by gas flows into the case body;
an outflow port out of which blow-by gas flows out of the case body; and
a cover fixed to the case body;
a separation unit arranged in the case body; and
an oil discharge unit arranged at a lower part of the case, wherein
the oil mist separator is configured to separate oil mist contained in blow-by gas by the separation unit and discharge oil separated by the separation unit to an outside of the case body through the oil discharge unit, and
the oil discharge unit includes:
a discharge port projecting from the cover and through which the oil is discharged to the outside of the case, and
a constriction arranged above the discharge port,
wherein at least a portion of the constriction protrudes into the cover.

7. The oil mist separator according to claim 6, wherein
an opening of the constriction through which the oil is discharged from the constriction deviates with respect to a center line of the discharge port.

8. The oil mist separator according to claim 6, wherein
the case body includes the constriction, and
the cover includes the discharge port, and covers the constriction.

9. The oil mist separator according to claim 6, wherein
the oil discharge unit includes a striking wall configured such that the blow-by gas flowing through the discharge port strikes the striking wall.

10. The oil mist separator according to claim 6, wherein
the cover is directly fixed to the case body.

11. The oil mist separator according to claim 6, wherein
the constriction has an inner diameter that is smaller than an inner diameter of the discharge port.

* * * * *